US008370149B2

(12) United States Patent
Tachibana et al.

(10) Patent No.: US 8,370,149 B2
(45) Date of Patent: Feb. 5, 2013

(54) SPEECH SYNTHESIS SYSTEM, SPEECH SYNTHESIS PROGRAM PRODUCT, AND SPEECH SYNTHESIS METHOD

(75) Inventors: Ryuki Tachibana, Kanagawa-ken (JP); Masafumi Nishimura, Kanagawa-ken (JP)

(73) Assignee: Nuance Communications, Inc., Burlington, MA (US)

( * ) Notice: Subject to any disclaimer, the term of this patent is extended or adjusted under 35 U.S.C. 154(b) by 769 days.

(21) Appl. No.: 12/192,510

(22) Filed: Aug. 15, 2008

(65) Prior Publication Data

US 2009/0070115 A1 Mar. 12, 2009

(30) Foreign Application Priority Data

Sep. 7, 2007 (JP) ..... 2007-232395

(51) Int. Cl.
*G10L 13/08* (2006.01)

(52) U.S. Cl. ..... 704/260; 704/258; 704/261; 704/266; 704/275; 704/243

(58) Field of Classification Search ..... 704/258, 704/260
See application file for complete search history.

(56) References Cited

U.S. PATENT DOCUMENTS

| | | | | |
|---|---|---|---|---|
| 3,828,132 | A * | 8/1974 | Flanagan et al. | 704/268 |
| 5,664,050 | A * | 9/1997 | Lyberg | 704/251 |
| 5,913,193 | A * | 6/1999 | Huang et al. | 704/258 |
| 6,173,263 | B1 * | 1/2001 | Conkie | 704/260 |
| 6,233,544 | B1 * | 5/2001 | Alshawi | 704/2 |
| 6,240,384 | B1 * | 5/2001 | Kagoshima et al. | 704/220 |
| 6,266,637 | B1 * | 7/2001 | Donovan et al. | 704/258 |
| 6,366,883 | B1 * | 4/2002 | Campbell et al. | 704/260 |
| 6,665,641 | B1 * | 12/2003 | Coorman et al. | 704/260 |
| 6,701,295 | B2 * | 3/2004 | Beutnagel et al. | 704/258 |
| 7,155,390 | B2 * | 12/2006 | Fukada | 704/254 |
| 7,280,969 | B2 * | 10/2007 | Eide et al. | 704/268 |
| 7,447,635 | B1 * | 11/2008 | Konopka et al. | 704/275 |
| 7,590,540 | B2 * | 9/2009 | Zhang et al. | 704/260 |
| 7,617,105 | B2 * | 11/2009 | Shi et al. | 704/260 |
| 7,761,296 | B1 * | 7/2010 | Bakis et al. | 704/247 |
| 7,856,357 | B2 * | 12/2010 | Mizutani et al. | 704/261 |
| 7,869,999 | B2 * | 1/2011 | Amato et al. | 704/260 |

(Continued)

OTHER PUBLICATIONS

Xi jun Ma, Wei Zhang, Weibin Zhu, Qin Shi and Ling Jin, "Probability Based Prosody Model for Unit Selection," proc. ICASSP, Montreal, 2004.*

E. Eide, A. Aaron, R. Bakis, R Cohen, R. Donovan, W. Hamza, T. Mathes, M. Picheny, M. Polkosky, M. Smith, and M. Viswanathan, "Recent improvements to the IBM trainable speech synthesis system," in Proc. of ICASSP, 2003, pp. I-708-I-711.*

(Continued)

*Primary Examiner* — Pierre-Louis Desir
*Assistant Examiner* — Fariba Sirjani
(74) *Attorney, Agent, or Firm* — Wolf, Greenfield & Sacks, P.C.

(57) ABSTRACT

Waveform concatenation speech synthesis with high sound quality. Prosody with both high accuracy and high sound quality is achieved by performing a two-path search including a speech segment search and a prosody modification value search. An accurate accent is secured by evaluating the consistency of the prosody by using a statistical model of prosody variations (the slope of fundamental frequency) for both of two paths of the speech segment selection and the modification value search. In the prosody modification value search, a prosody modification value sequence that minimizes a modified prosody cost is searched for. This allows a search for a modification value sequence that can increase the likelihood of absolute values or variations of the prosody to the statistical model as high as possible with minimum modification values.

15 Claims, 7 Drawing Sheets

U.S. PATENT DOCUMENTS

| | | | | |
|---|---|---|---|---|
| 7,921,014 | B2 * | 4/2011 | Kurata et al. | 704/260 |
| 8,015,011 | B2 * | 9/2011 | Nagano et al. | 704/260 |
| 2005/0137870 | A1 * | 6/2005 | Mizutani et al. | 704/264 |
| 2005/0182629 | A1 * | 8/2005 | Coorman et al. | 704/266 |
| 2006/0074674 | A1 * | 4/2006 | Zhang et al. | 704/260 |
| 2006/0074678 | A1 * | 4/2006 | Pearson et al. | 704/267 |
| 2008/0195391 | A1 * | 8/2008 | Marple et al. | 704/260 |
| 2009/0083036 | A1 * | 3/2009 | Zhao et al. | 704/260 |
| 2010/0076768 | A1 * | 3/2010 | Kato et al. | 704/266 |
| 2012/0059654 | A1 * | 3/2012 | Nishimura et al. | 704/243 |

OTHER PUBLICATIONS

Donovan, R.E., et al. "Current Status of the IBM Trainable Speech Synthesis System," Proc. 4th ISCA Tutorial and Research Workshop on Speech Synthesis. Atholl Palace Hotel, Scotland, 2001.*

Black, A. W., Taylor, P., "Automatically clustering similar units for unit selection in speech synthesis," Proc. Eurospeech '97, Rhodes, pp. 601-604, 1997.*

Office Action mailed Feb. 28, 2012 in corresponding Japanese Application No. 2007-232395.

* cited by examiner

SPEECH SYNTHESIS SYSTEM, SPEECH SYNTHESIS PROGRAM PRODUCT, AND SPEECH SYNTHESIS METHOD

CROSS-REFERENCE TO RELATED APPLICATIONS

The present application claims the benefit under 35 U.S.C. §119 of Japan; Application Serial Number 2007-232395, filed Sep. 7, 2007 entitled "SPEECH SYNTHESIS SYSTEM, SPEECH SYNTHESIS PROGRAM PRODUCT, AND SPEECH SYNTHESIS METHOD," which is incorporated herein by reference

TECHNICAL FIELD

The present invention relates to a speech synthesis technology for synthesizing speech by computer processing and particularly to a technology for synthesizing the speech with high sound quality.

BACKGROUND

It is important to synthesize speech with accurate and natural accent in speech synthesis. Therefore, there is known a concatenative speech synthesis technology as one of speech synthesis technologies. This technology generates synthesized speech by selecting speech segments having similar prosody to the target prosody predicted using a prosody model from a speech segment database and concatenating them. The first advantage of this technology is that it can provide high sound quality and naturalness close to those of a recorded human voice in a portion where appropriate speech segments are selected. Particularly, the fine tuning (smoothing) of prosody is unnecessary in a portion where originally continuous speech segments (continuous speech segments) in speaker's original speech can be used for the synthesized speech directly in the concatenated sequence, and therefore the best sound quality with natural accent is achieved.

In the waveform concatenation speech synthesis, however, accurate and natural prosody cannot always be produced by synthesis. It is because the consistency of prosody may be lost as a result of concatenating speech segments selected based on minimizing cost. Particularly in Japanese, a relationship in pitch between moras is recognized as a pitch accent. Therefore, unless the prosody generated as a result of concatenating the speech segments is consistent as a whole, the naturalness of synthesized speech is lost. In addition, the high naturalness of accent cannot always be obtained when continuous speech segments are used for synthesized speech. It is because an accent depends on a context, the frequency of speech may be different according to the context even if the accent is the same, and the prosody may become unnatural at the connection of the accent as a whole in the case of poor consistency with outer portions of the continuous speech segments.

Japanese Unexamined Patent Publication (Kokai) No. 2005-292433 discloses a technology for: acquiring a prosody sequence for target speech to be speech-synthesized with respect to a plurality of respective segments, each of which is a synthesis unit of speech synthesis; associating a fused speech segment obtained by fusing a plurality of speech segments, which are intended for the same speech unit and different in prosody of the speech unit from each other, with fused speech segment prosody information indicating the prosody of the fused speech segment and holding them; estimating a degree of distortion between segment prosody information indicating the prosody of segments obtained by division and the fused speech segment prosody information; selecting a fused speech segment based on the degree of the estimated distortion; and generating synthesized speech by concatenating the fused speech segments selected for the respective segments. Japanese Unexamined Patent Publication (Kokai) No. 2005-292433, however, does not suggest a technique for treating continuous speech segments.

The following document [1] discloses that a speech segment sequence having the maximum likelihood is obtained by learning the distribution of absolute values and relative values of a fundamental frequency (F0) in a prosody model for use in waveform concatenation speech synthesis. Also in the technique disclosed in this document, however, unnatural prosody is produced by the synthesis without speech segments. Although it is possible to use a F0 curve having the maximum likelihood forcibly as the prosody of synthesized speech, the naturalness only possible in the waveform concatenation speech synthesis is lost.

On the other hand, the following document [2] discloses that speech segment prosody is used directly for continuous speech segments since discontinuity never occurs in the continuous speech segments. In this technique, the synthesized speech is used after smoothing the speech segment prosody in the portions other than the continuous speech segments.

[Patent Document 1]

Japanese Unexamined Patent Publication (Kokai) No. 2005-292433

[Nonpatent Document 1]

[1] Xi jun Ma, Wei Zhang, Weibin Zhu, Qin Shi and Ling Jin, "PROBABILITY BASED PROSODY MODEL FOR UNIT SELECTION," proc. ICASSP, Montreal, 2004.

[Nonpatent Document 2]

[2] E. Eide, A. Aaron, R. Bakis, R Cohen, R. Donovan, W. Hamza, T. Mathes, M. Picheny, M. Polkosky, M. Smith, and M. Viswanathan, "Recent improvements to the IBM trainable speech synthesis system," in Proc. of ICASSP, 2003, pp. I-708-I-711.

SUMMARY

In the waveform concatenation speech synthesis, preferably synthesized speech is produced with high sound quality where accents are naturally connected in the case where there are large quantities of speech segments, while synthesized speech can be produced with accurate accents even if the above is not the case. Stated another way, preferably a sentence having a similar content to recorded speaker's speech is synthesized with high sound quality, while any other sentence can be synthesized with accurate accents. In the above conventional technology, however, it is difficult to synthesize speech with natural quality in some cases.

Therefore, it is an object of the present invention to provide a speech synthesis technology that not only allows a sentence having a similar content to recorded speaker's speech to be synthesized with high quality, but allows a sentence having a dissimilar content to the recorded speaker's speech to be synthesized with stable quality.

The present invention has been provided to solve the above problem and it provides prosody with high accuracy and high sound quality by performing a two-path search including a speech segment search and a prosody modification value search. In the preferred embodiment of the present invention, an accurate accent is secured by evaluating the consistency of prosody by using a statistical model of prosody variations (the slope of fundamental frequency) for both of two paths of the speech segment selection and the modification value search. In the prosody modification value search, a prosody modification value sequence that minimizes a modified prosody cost is searched for. This allows a search for a modification value sequence that can increase the likelihood of absolute values or variations of the prosody to the statistical model as high as possible with minimum modification values. With regard to the continuous speech segments, an evaluation is made to determine whether they keep the consistency by using the statistical model of prosody variations similarly and only correct continuous speech segments are treated on a priority basis. The term "treated on a priority basis" means that the best sound quality is achieved by leaving the fine tuning undone in the corresponding portion, first. In addition, the prosody of other speech segments is modified with the priority continuous speech segments particularly weighted in the modification value search so as to ensure that other speech segments have correct consistency in the relationship with the prior continuous speech segments. The consistency of the fundamental frequency is evaluated by modeling the slope of the fundamental frequency using the statistical model and calculating the likelihood for the model. Stable values can be observed independently of a mora length and the consistency can be evaluated in consideration of all parts of the fundamental frequency within the range by using the slope obtained by linear-approximating the fundamental frequency within a certain time interval, instead of a difference from the fundamental frequency in a position in an adjacent mora, which contributes to the reproduction of an accent that sounds accurate to a human ear. The slope of the fundamental frequency is calculated during learning, for example, by linear-approximating a curve generated by interpolating pitch marks in a silent section by linear interpolation first and then smoothing the entire curve, preferably within a range from a point obtained by equally dividing each mora to a point traced back for a certain time period.

According to the present invention, it is possible to obtain an effect that high-quality speech synthesis is achieved by detecting and thereby advantageously utilizing original speech segments as continuous speech segments, if any, and even if not, high-quality speech synthesis is achieved by evaluating the consistency of prosody using a statistical model of prosody variations to secure accurate accents.

BRIEF DESCRIPTION OF THE DRAWINGS

FIG. 7 is a diagram illustrating a difference in the process between the case where continuous speech segments are priority continuous speech segments and a case other than that.

DETAILED DESCRIPTION

Figure 1:
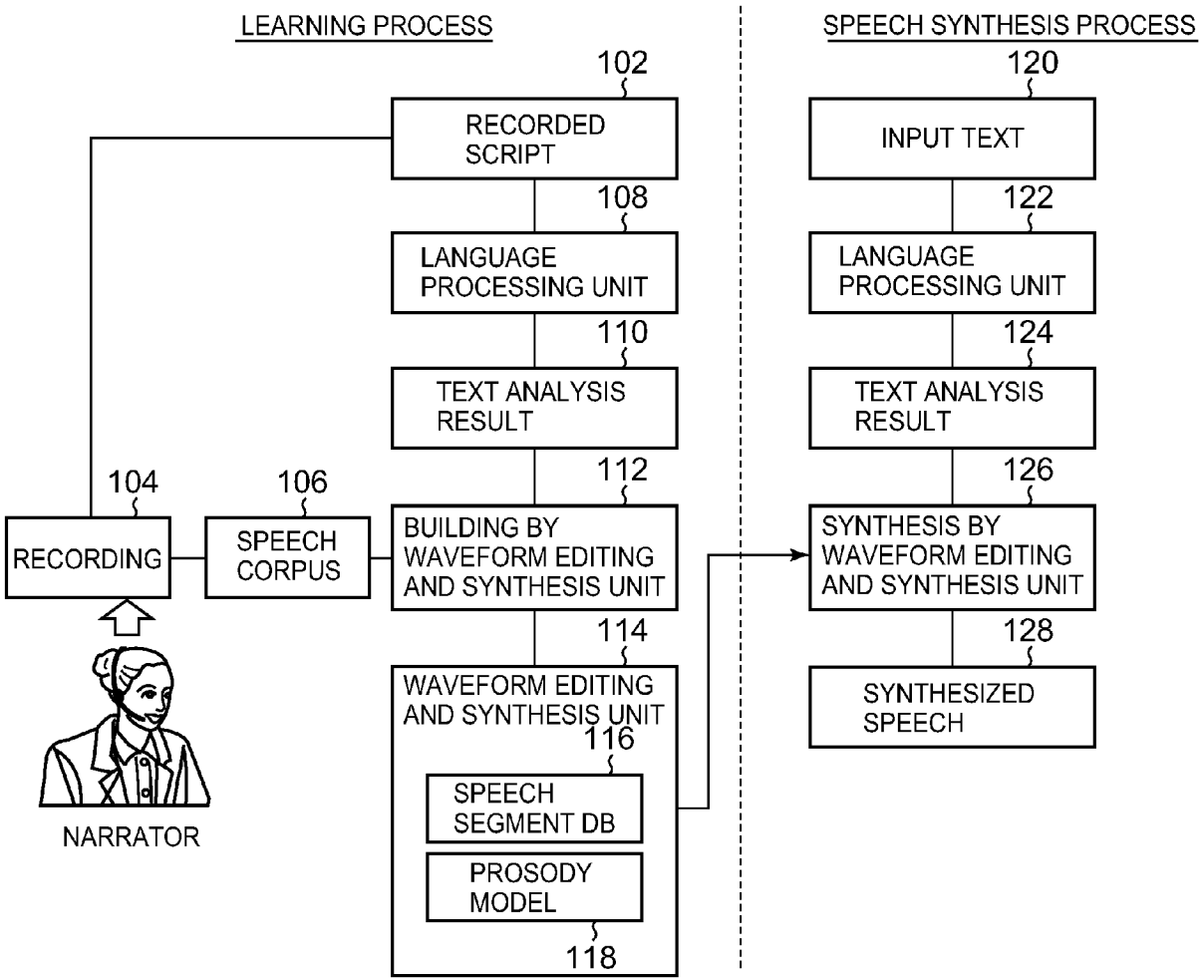
FIG. 1 is an outline block diagram illustrating a learning process which is the premise of the present invention and an entire speech synthesis process.

Hereinafter, the present invention will be described by way of embodiments with reference to accompanying drawings. Unless otherwise indicated, the same reference numerals will be used to refer to the same elements in the entire description below.

Referring to FIG. 1, there is shown an outline block diagram illustrating the overview of speech processing which is the premise of the present invention. The left part of FIG. 1 is a processing block diagram illustrating a learning step of preparing necessary information such as a speech segment database and a prosody model necessary for speech synthesis. The right part of FIG. 1 is a processing block diagram illustrating a speech synthesis step.

In the learning process, a recorded script 102 includes at least several hundred sentences corresponding to various fields and situations in a text file format.

On the other hand, the recorded script 102 is read aloud by a plurality of narrators preferably including men and women, the read-out speech is converted to a speech analog signal through a microphone (not shown) and then A/D-converted, and the A/D-converted speech is stored preferably in PCM format into the hard disk of a computer. Thus, a recording process 104 is performed. Digital speech signals stored in the hard disk constitute a speech corpus 106. The speech corpus 106 can include analytical data such as classes of recorded speeches.

At the same time, a language processing unit 108 performs processing specific to the language of the recorded script 102. More specifically, it obtains the reading (phonemes), accents, and word classes of the input text. Since no space is left between words in some languages, there may also be a need to divide the sentence in word units. Therefore, a parsing technique is used, if necessary.

In a text analysis result block 110, a reading and accent are assigned to each of the divided words. It is performed with reference to a prepared dictionary in which a reading is associated with an accent for each word.

In a building block 112 by a waveform editing and synthesis unit, the speech is divided into speech segments (an alignment of speech segments is obtained).

The waveform editing and synthesis unit 114 observes the fundamental frequency preferably at three equally spaced points of each mora on the basis of speech segment data generated in the building block 112 by the waveform editing and synthesis unit and constructs a decision tree for predicting this. Furthermore, the distribution is modeled by the Gaussian mixture model (GMM) for each node of the decision tree. More specifically, the decision tree is used to cluster the input feature values so as to associate the probability distribution determined by the Gaussian mixture model with each cluster. A speech segment database 116 and a prosody model 118 constructed as described above are stored in the hard disk of the computer. Data of the speech segment database 116 and that of the prosody model 118 prepared in this manner can be copied to another speech synthesis system and used for an actual speech synthesis process.

Note that the above processing of observing the fundamental frequency at three equally spaced points of each mora is appropriate for Japanese, though it may be more appropriate in other languages such as English and Chinese that the observation points are determined in consideration of syllables or other elements in some cases.

Subsequently, the speech synthesis process will be described with reference to FIG. 1. The speech synthesis process is basically to read aloud a sentence provided in a text format via text-to-speech (TTS). This type of input text 120 is typically generated by an application program of the computer. For example, a typical computer application program displays a message in a popup window format for a user, and the message can be used as an input text. For a car navigation system, an instruction such as, for example, "Turn to the right at the intersection located 200 meters ahead" is used as text to be read aloud.

Subsequently, a language processing unit 122 obtains the reading (phonemes), accents, and word classes of the input text, similarly to the above processing of the language processing unit 108. In the case of a Japanese input text, the sentence is divided into words in this process, too.

Subsequently, in a text analysis result block 124, a reading and accent are assigned to each of the divided words similarly to the text analysis result block 110 in response to a processing output of the language processing unit 122.

In a synthesis block 126 by the waveform editing and synthesis unit, typically the following processes are sequentially performed:

Obtaining prosody modification values using the prosody model 118;

Reading candidates of speech segments from the speech segment database 116;

Getting a speech segment sequence;

Applying prosody modification appropriately; and

Generating synthesized speech by concatenating speech segments.

Thus, the synthesized speech 128 is obtained. The signal of the synthesized speech 128 is converted to an analog signal by DA conversion and is output from a speaker.

Figure 2:
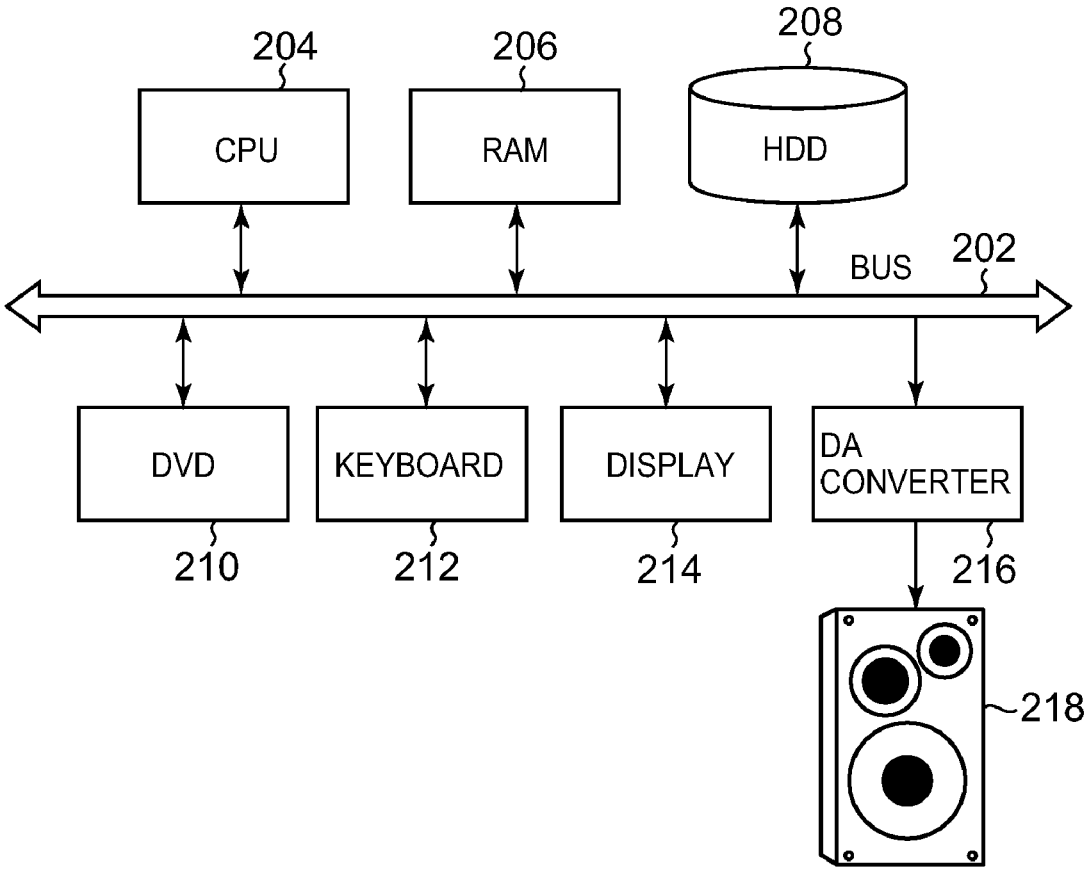
FIG. 2 is a block diagram of hardware for practicing the present invention.

Referring to FIG. 2, there is shown a block diagram illustrating a basic structure of the speech synthesis system (text-to-speech synthesis system) according to the present invention. Although this embodiment will be described under the assumption that the configuration in FIG. 2 is applied to a car navigation system, it should be appreciated that the present invention is not limited thereto, but the invention may be applied to an arbitrary information processor having a speech synthesis function such as a vending machine or any other arbitrary built-in device and an ordinary personal computer.

In FIG. 2, a bus 202 is connected to a CPU 204, a main storage (RAM) 206, a hard disk drive (HDD) 208, a DVD drive 210, a keyboard 212, a display 214, and a DA converter 216. The DA converter 216 is connected to the speaker 218 and thus speech synthesized by the speech synthesis system according to the present invention is output from the speaker 218. In addition, the car navigation system is equipped with a GPS function and a GPS antenna, though they are not shown.

Furthermore, in FIG. 2, the CPU 204 has a 32-bit or 64-bit architecture that enables the execution of an operating system such as TRON, Windows® Automotive, and Linux®.

The HDD 208 stores data of the speech segment database 116 generated by the learning process in FIG. 1 and data of the prosody model 118. The HDD 208 further stores an operating system, a program for generating information related to a location detected by the GPS function or other text data to be speech-synthesized, and a speech synthesis program according to the present invention. Alternatively, these programs can be stored in an EEPROM (not shown) so as to be loaded into the main storage 206 from the EEPROM at power on.

The DVD drive 210 is for use in mounting a DVD having map information for navigation. The DVD can store a text file to be read aloud by the speech synthesis function. The keyboard 212 substantially includes operation buttons provided on the front of the car navigation system.

The display 214 is preferably a liquid crystal display and is used for displaying a navigation map in conjunction with the GPS function. Moreover, the display 214 appropriately displays a control panel or a control menu to be operated through the keyboard 212.

The DA converter 216 is for use in converting a digital signal of the speech synthesized by the speech synthesis system according to the present invention to an analog signal for driving the speaker 218.

Figure 3:
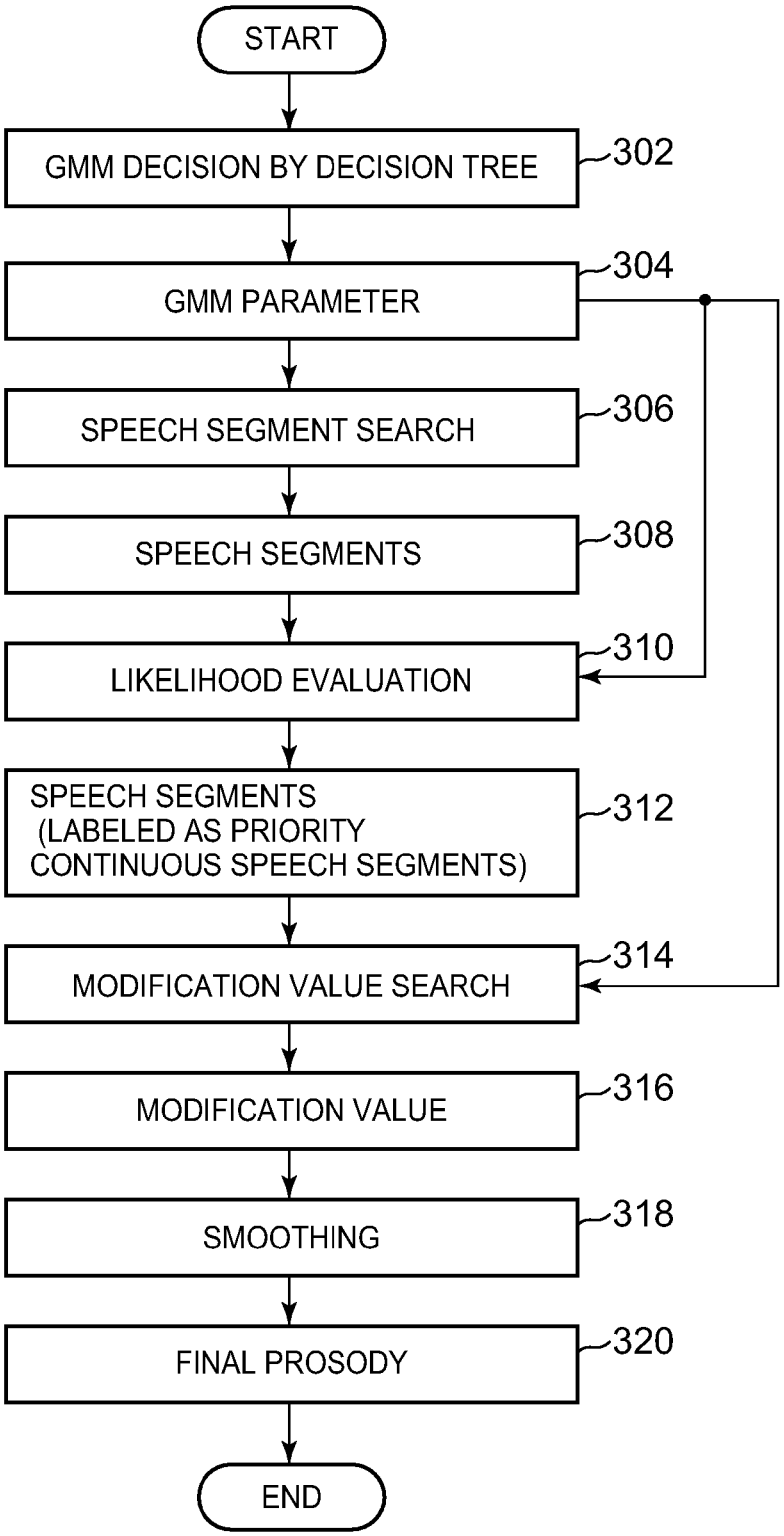
FIG. 3 is a flowchart of the main process of the present invention.

Referring to FIG. 3, there is shown a flowchart illustrating processing of the speech segment search and the prosody modification value search according to the present invention. A processing module for this processing is included in the synthesis block 126 by the waveform editing and synthesis unit in the configuration shown in FIG. 1. Moreover, in FIG. 2, it is stored in the hard disk drive 208 and executable loaded into the RAM 206. Prior to describing the flowchart shown in FIG. 3, a plurality of types of prosody to be used during processing will be described below.

1. Speech Segment Prosody.

Prosody indigenous to the speaker's original speech.

2. Target Prosody.

Prosody predicted using a prosody model for an input sentence in the runtime of a conventional approach. Generally, in the conventional approach, speech segments having speech segment prosody close to this value are selected. Note that, however, the target prosody is basically not used in the approach of the present invention. More specifically, speech segments are selected because of its speech segment prosody having a high likelihood to the model stochastically representing the features of the speaker's prosody, instead of being selected because of the similar prosody to the target prosody.

3. Final Prosody.

Prosody finally assigned to the synthesized speech. There are pluralities of options available for a value therefore.

3-1. Directly Using Speech Segment Prosody.

Since speech segments are used without modification in this option, the best sound quality may be achieved. Discontinuous prosody, however, may occur between the speech segments and speech segments adjacent thereto, which leads to deterioration of the sound quality on the contrary in some cases. Since such discontinuous prosody never occurs in continuous speech segments, this method is used only in such a portion in the conventional approach.

3-2. Using Smoothed Speech Segment Prosody.

In this option, the speech segment prosody is smoothed in adjacent speech segments to obtain the final prosody. This eliminates discontinuity in accent and thereby the speech sounds smooth. In the conventional approach, this method is generally used in the portions other than the continuous speech segments. In that case, however, an inaccurate accent may be produced unless there are any speech segments having the similar speech segment prosody to the target prosody.

3-3. Using Target Prosody.

In this option, the target prosody is forcibly used. As described above, the target prosody is determined by predicting the target prosody using the prosody model for the input sentence as described above. If this method is used, a major modification is required for the speech segments in a portion where there are no speech segments having the similar speech segment prosody to the target prosody, and the sound quality significantly deteriorates in that portion. Although this method is one of the conventional technologies, it is an undesirable method since it impairs the advantage of the high sound quality of the waveform concatenation speech synthesis.

3-4. Using Speech Segment Prosody with Partial Modification.

In this option, the speech segment prosody is basically used, while the likelihood is evaluated to use calculations of the final prosody depending on each part. In this technique, the speech segment prosody is directly used similarly to 3-1 for a portion where the likelihood is sufficiently high in the continuous speech segments (priority continuous speech segments). The best sound quality is achieved by directly using the speech segment prosody for the portion sufficiently high in likelihood. For a portion where the likelihood is low in the continuous speech segments, it is considered to be other than the continuous speech segments and then the following process is performed. Specifically, the speech segment prosody is smoothed before it is used similarly to 3-2 for a portion whose likelihood is relatively high regarding other speech segments than the continuous speech segments. Thereby, considerably high sound quality is obtained. For a portion whose likelihood is relatively low, the prosody is modified with the minimum modification values so as to increase the likelihood and then the modified prosody is used as the final prosody. The sound quality is not as high as the above one. We can say that this case is similar to the case of 3-3.

Figure 4:
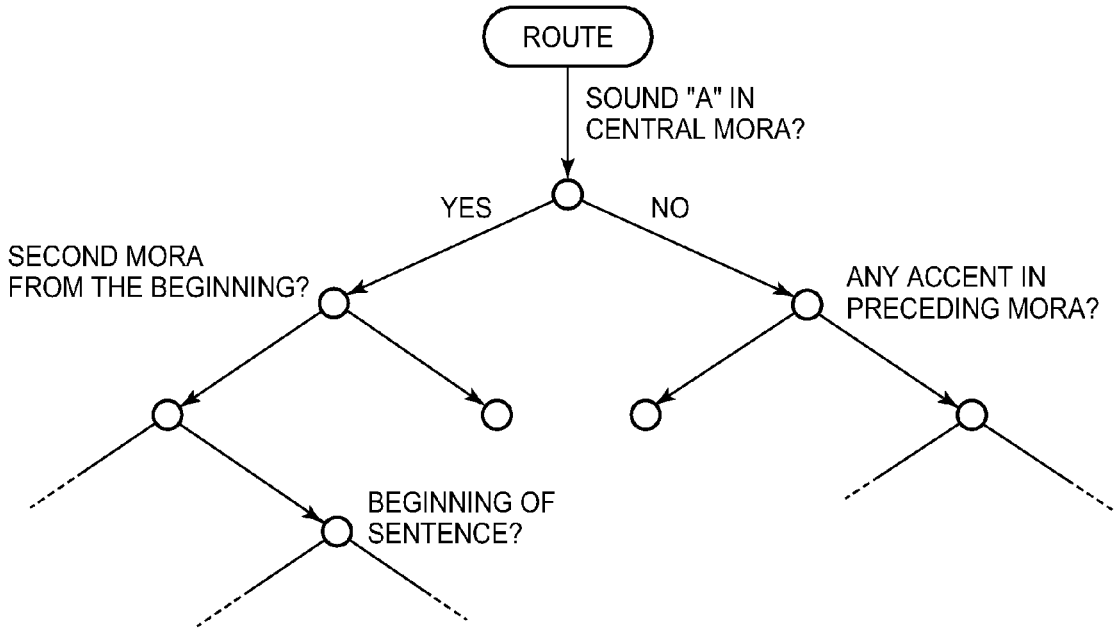
FIG. 4 is a diagram illustrating an example of a decision tree.

Now, returning to the flowchart shown in FIG. 3, in step 302, the GMM (Gaussian mixture model) decision is made using a decision tree. Note that the decision tree is, for example, as shown in FIG. 4 and questions are associated with respective nodes. The control reaches an end-point by following the tree according to the determination of yes or no on the basis of the input feature value. FIG. 4 illustrates an example of the decision tree based on the questions related to the positions of moras within a sentence. As described above, the decision tree is used for the GMM decision and a GMM ID number is associated with its end-point. The GMM parameter is obtained by checking the table using the ID number. The term "GMM," namely "the Gaussian mixture distribution" is the superposition of a plurality of weighted normal distributions, and the GMM parameter includes an average, dispersion, and a weighting factor.

According to the present invention, the input feature values to the decision tree include a word class, the type of speech segment, and the position of mora within the sentence. On the other hand, the term "output parameter" means a GMM parameter of a frequency slope or an absolute frequency. The combination of the decision tree and GMM is used to predict the output parameter based on the input feature values. The related technology is conventionally known and therefore a more detailed description is omitted here. For example, refer to the above document [1] or the specification of Japanese Patent Application No. 2006-320890 filed by the present applicant.

If the GMM parameter is obtained in step 304, then speech segments are searched for by using the GMM parameter in step 306. The speech segment database 116 contains a speech segment list and actual voices of respective speech segments. Moreover, in the speech segment database 116, each speech segment is associated with information such as a start-edge frequency, end-edge frequency, sound volume, length, and tone (cepstrum vector) at the start edge or end edge. In step 306, the above information is used to obtain a speech segment sequence having the minimum cost.

In this situation, it is necessary to clarify what kind of cost should be employed.

In the typical conventional technology, a speech segment sequence is selected which minimizes the sum of the costs described below. The costs in the conventional technology are basically based on the disclosure of the above document [2].

1. Spectrum Continuity Cost

The spectrum continuity cost is applied as a cost (penalty) to a difference across the spectrum so that the tones (spectrum) are smoothly connected in the selection of the speech segments.

2. Frequency Continuity Cost

The frequency continuity cost is applied as a cost to a difference of the fundamental frequency so that the fundamental frequencies are smoothly connected in the selection of the speech segments.

3. Duration Error Cost

The duration error cost is applied as a cost to a difference between target duration and speech segment duration so that the speech segment duration (length) is close to duration predicted using the prosody model in the selection of the speech segments.

4. Volume Error Cost

The volume error cost is applied as a cost to a difference between a target sound volume and a speech segment volume.

5. Frequency Error Cost

The frequency error cost is applied as a cost to an error of a speech segment frequency (speech segment prosody) from a target frequency, where the target frequency (target prosody) is previously obtained.

In the present invention, the frequency error cost and the frequency continuity cost are omitted among the above costs as a result of reconsidering the costs of the conventional technology. Instead, an absolute frequency likelihood cost (Cla), a frequency slope likelihood cost (Cld), and a frequency linear approximation error cost (Cf) are introduced.

The absolute frequency likelihood cost (Cla) will be described below. In the case of Japanese, preferably the fundamental frequency is observed at three equally spaced points of each mora and a decision tree for predicting it is constructed during learning. Furthermore, the distribution is modeled by the Gaussian mixture model (GMM) for the nodes of the decision tree. Thus, in the runtime, the decision tree and GMM are used to calculate the likelihood of the speech segment prosody of the speech segments currently under consideration. Then, its log likelihood is positive-negative reversed and an external weighting factor is applied thereto to obtain the cost. The reason why the frequency likelihood is used instead of the target frequency is because the approximation to one frequency is not indispensable only if there is a consistency with adjacent speech segments in producing a Japanese accent. Therefore, GMM is employed with the aim of increasing the choices of speech segments here.

The frequency slope likelihood cost (Cld) will be described below. During learning, preferably the slope of the fundamental frequency is observed at three equally spaced points of each mora and a decision tree for predicting it is constructed. Moreover, the distribution is modeled by GMM for the nodes of the decision tree. In the runtime, the decision tree and GMM are used to calculate the likelihood of the slope of the speech segment sequence currently under consideration. Then, its log likelihood is positive-negative reversed and an external weighting factor is applied thereto to obtain the cost. The slope is calculated during learning within a range from the position under consideration to a point going back, for example, 0.15 sec. Also in the runtime, the slope of the speech segments is calculated within a range from the speech segment under consideration to a point going back 0.15 sec similarly to calculate the likelihood. The slope is calculated by obtaining an approximate straight line having the minimum square error.

The frequency linear approximation error cost (Cf) will be described below. While a change in the log frequency within the above range of 0.15 sec is approximated by a straight line when the frequency slope likelihood is calculated, the external weighting factor is applied to its approximation error to obtain the frequency linear approximation error cost (Cf).

This cost is used due to the following two reasons: (1) If the approximation error is too large, the calculation of the frequency slope cost becomes meaningless; and (2) The prosody of the concatenated speech segments should change smoothly to the extent that the change can be approximated by the first-order approximation during the short time period of 0.15 sec.

Summarizing the above, in this embodiment of the present invention, the speech segment sequence is determined by a beam search so as to minimize the spectrum continuity cost, the duration error cost, the volume error cost, the absolute frequency likelihood cost, the frequency slope likelihood cost, and the frequency linear approximation error cost. The beam search is to limit the number of steps in the best-first search for rationalization of the search space. Thus, in step 308, the speech segment sequence is determined.

In this embodiment, different decision trees are used for the spectrum continuity cost, the duration error cost, the volume error cost, the absolute frequency likelihood cost, the frequency slope likelihood cost, and the frequency linear approximation error cost, respectively. Alternatively, however, for example, the volume, frequency, and duration are combined as a vector and a value of the vector can be estimated at a time using a single decision tree.

The likelihood evaluation in step 310 is intended for a continuous speech segment portion including continuous speech segments selected by the number exceeding an externally provided threshold value Tc in the selected speech segment sequence: The frequency slope likelihood cost Cld of that portion is compared with another externally provided threshold value Td. Only the portion exceeding the threshold value is handled as "priority continuous speech segments" as shown in step 312 in the subsequent processes. Handling of the priority continuous speech segments will be described later with reference to the flowchart of FIG. 5.

Subsequently, the prosody modification value search in step 314 will now be described. In this step, an appropriate modification value sequence for the speech segment prosody sequence is obtained by a Viterbi search. Specifically, in this case, the Viterbi search is used to find the prosody modification value sequence so as to maximize the likelihood estimation of the speech segment prosody sequence through the dynamic programming. Also in this process, the GMM parameter obtained in step 304 is used. Alternatively, the beam search can be used, instead of the Viterbi search, to obtain the prosody modification value sequence in this step, too. One modification value is selected out of candidates determined discretely within the previously determined range from the lower limit to the upper limit (For example, from −100 Hz to +100 Hz at intervals of 10 Hz). The modified speech segment prosody is evaluated by the sum of the following costs, namely modified prosody cost:

1. Absolute frequency likelihood cost (Cla)
2. Frequency slope likelihood cost (Cld)
3. Frequency linear approximation error cost (Cf)
4. Prosody modification cost (Cm)

Note here that the terms, "absolute frequency likelihood cost," "frequency slope likelihood cost," and "frequency linear approximation error cost" are the same as those of the above speech segment search, but different decision trees from those of the calculation of the costs for the speech segment search are used to calculate the modified prosody cost. Input variables used for the decision trees, however, are the same as existing input variables used for the decision tree of the frequency error cost. Note here that it is also possible to estimate a two-dimensional vector which is the combination of the absolute frequency likelihood cost and the frequency slope likelihood cost through one decision tree at a time.

The prosody modification cost means a cost (penalty) for a modification value for the modification of a speech segment F0. The reason why it is referred to as penalty is because the sound quality deteriorates as the modification value increases. The prosody modification cost is calculated by multiplying the modification value of the prosody by an external weight. Note that, however, for the priority continuous speech segments, the prosody modification cost is calculated by multiplying the cost by another external large weight or the cost is set to an extremely large constant to inhibit the modification value to be other than zero. Thereby, a modification value is selected so as to be consistent with the prosody of the priority continuous speech segments in the vicinity of the priority continuous speech segments. Thus, in step 316, the prosody modification value for each speech segment is determined.

In this embodiment, no decision tree is used to calculate the prosody modification cost (Cm). It is based on a concept that the prosody modification should be small for all phonemes equally. If, however, it is expected that the sound quality of some phonemes does not deteriorate even after the prosody modification while the sound quality of other phonemes significantly deteriorates after the prosody modification and it is desirable to perform different prosody modification for them, the use of a decision tree is appropriate for the prosody modification cost, too.

In step 318, the prosody modification value obtained in step 316 is applied to each speech segment to smooth the prosody. Thus, in step 320, the prosody to be finally applied to the synthesized speech is determined.

Figure 5:
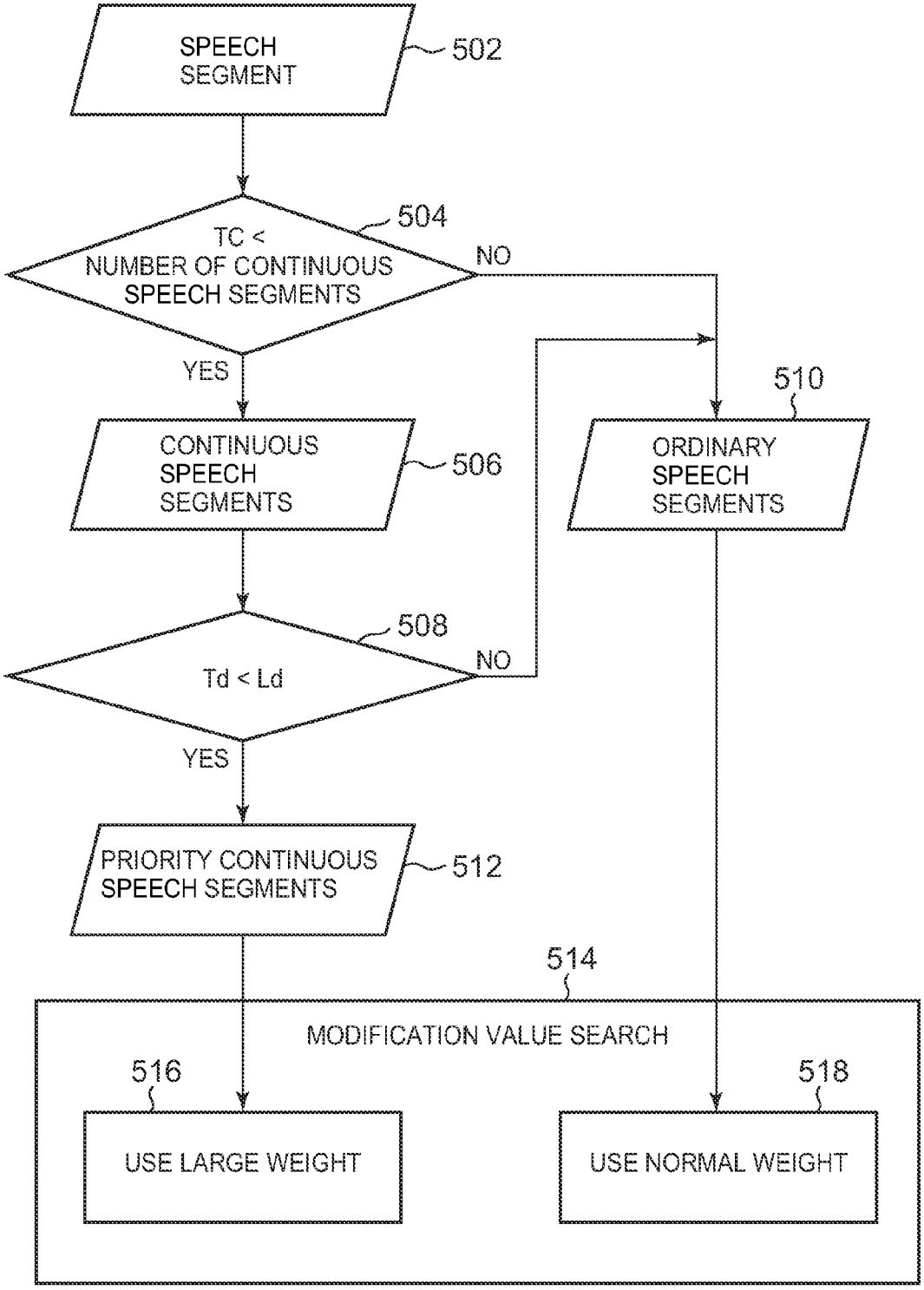
FIG. 5 is a flowchart of the process for determining priority continuous speech segments.

Referring to FIG. 5, there is shown a flowchart of processing for determining a weight for the modification value cost, which is used in the modification value search 314 shown in FIG. 3. In FIG. 5, the speech segments are checked one by one in step 502. Then, in step 504, it is determined whether the number of continuous speech segments is greater than the intended threshold value Tc. The term "continuous speech segments" means a sequence of speech segments that have been originally continuous in the original speaker's speech and can be used for the synthesized speech directly in the concatenated sequence. If the number of continuous speech segments is smaller than the intended threshold value Tc, the speech segments are immediately determined to be ordinary speech segments in 510.

If the number of continuous speech segments is greater than the intended threshold value Tc in step 504, the speech segments are considered to be continuous speech segments for the time being in step 506. The Tc value is 10 in one example. The speech segment sequence, however, is not treated specially only for this reason. Next in step 508, it is determined whether the slope likelihood Ld of the continuous speech segment portion is greater than the given threshold value Td in step 508: If it is not so, the control progresses to step 510 to consider it to be ordinary speech segments after all; and only after the slope likelihood Ld is determined to be greater than the given threshold value Td in step 508, the speech segment sequence is considered to be priority continuous speech segments. The frequency slope likelihood cost (Cld) is obtained by assigning a negative weight to the log of the slope likelihood Ld. The consideration of the priority continuous speech segments corresponds to step 312 shown in FIG. 3.

If the speech segment sequence is considered to be the priority continuous speech segments, a large weight is used as shown in step 516 in a prosody modification value search 514.

The large weight used for the priority continuous speech segments substantially or completely inhibits the prosody modification to be applied to the priority continuous speech segments.

On the other hand, if the speech segment sequence is considered to be ordinary speech segments, a normal weight is used as shown in step 518 in the prosody modification value search 514.

In this embodiment, a weight of 1.0 or 2.0 is used for the ordinary speech segments, and a weight that is twice to 10 times larger than the weight for the ordinary speech segments is used for the priority continuous speech segments.

Meanwhile, three equally spaced points of each mora are selected as described above as observation points for the fundamental frequency and the frequency slope in this embodiment. It should be appreciated that the above is consideration peculiar to the Japanese language to some extent. It is because a mora is a unit of speech in Japanese, while a syllable may be a unit of speech in another language. If the above is applied directly in the latter case, three equally spaced points of each syllable are selected, but the use of them will lead to an unsuccessful result in some cases.

For example, in the case of English, the syllable has a structure of a consonant (onset)+vowel (nucleus=vowel)+consonant (coda). In this case, the onset or coda may be omitted. If the observation points are placed at three equally spaced points of the syllable when the coda includes a voiceless consonant such as /s/ or /t/, the third point comes behind the coda which is the voiceless consonant. Actually, however, the fundamental frequency does not exist in a voiceless consonant and therefore the third point may be meaningless. Moreover, the use of the observation point for the coda may reduce the important observation points for use in modeling the fundamental frequency of a vowel.

On the other hand, in the case of Chinese, the coda includes only a voiced consonant and therefore the same problem as English does not occur. In Chinese, however, the forms of the fundamental frequencies of the four tones are very important, and they have important implications only in vowels. Almost all of consonants are voiceless consonants or plosive sounds in Chinese and they do not have a fundamental frequency, and therefore modeling of the corresponding portion is unnecessary. Moreover, the ups and downs of the fundamental frequency in Chinese are very significant, and therefore the frequency slope cannot be modeled successfully by observation at three points.

In Japanese, there is no coda, but there are many voiced consonants each having a fundamental frequency such as /m/, /n/, /r/, /w/, and /y/. Therefore, the method of placing observation points at three equally spaced points of each mora is effective.

Thus, it should be appreciated that it is necessary to appropriately change the positions and number of observation points for calculating the absolute frequency likelihood cost (Cla) and frequency slope likelihood cost (Cld) described above according to the phonetic characteristics of a language.

Figure 6:
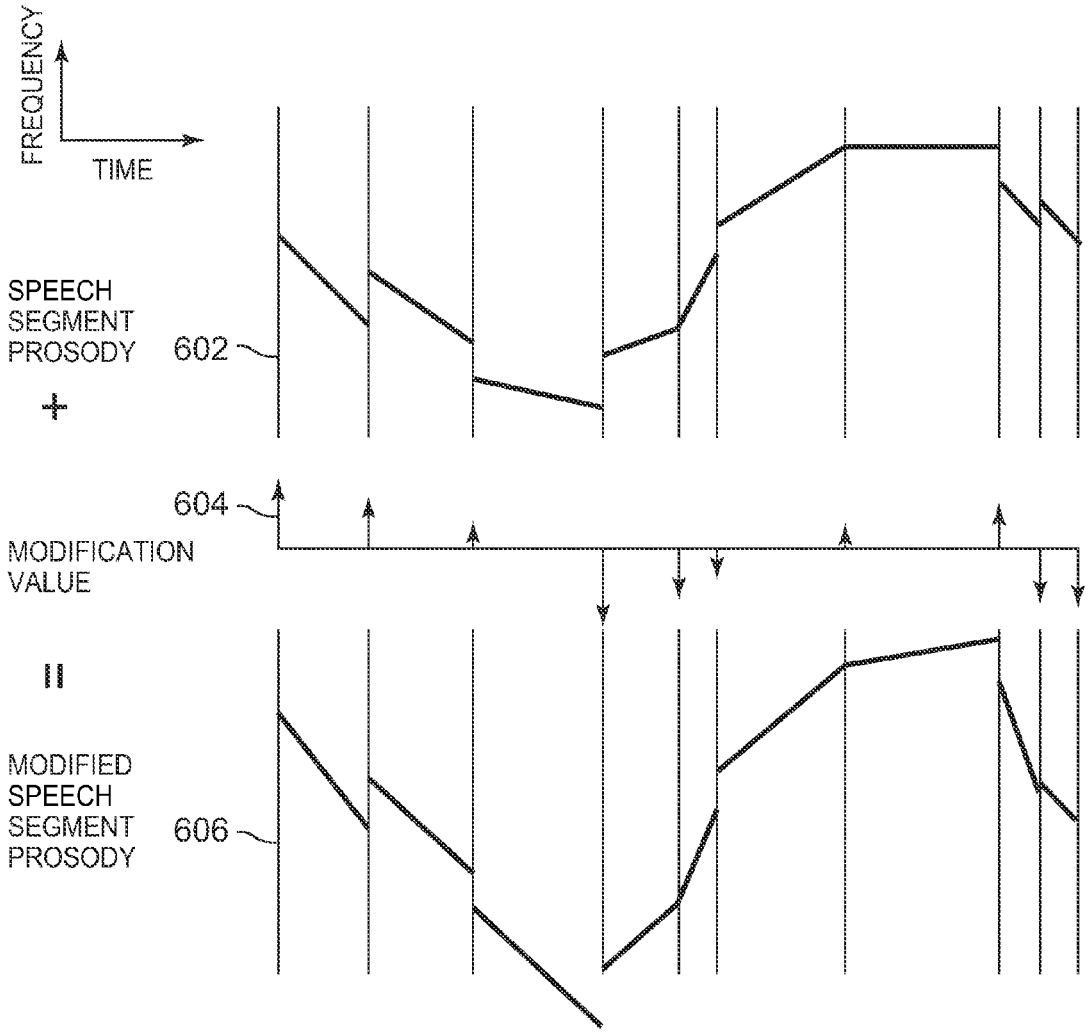
FIG. 6 is a diagram illustrating the state of applying prosody modification values to speech segments.

Referring to FIG. 6, there is shown a diagram illustrating the state of modifying speech segment prosody. In FIG. 6, the ordinate axis represents a frequency axis and an abscissa axis represents a time axis. A graph 602 shows the concatenated state of the speech segments determined by the speech segment search in step 306 of the flowchart in FIG. 3: a plurality of vertical lines represent boundaries between the speech segments. At this time point, the prosody of the original speech segments is shown as it is.

A graph 604 shows prosody modification values for the respective speech segments, which are determined in the prosody modification value search in step 314 of the flowchart in FIG. 3. Moreover, a graph 606 illustrates modified speech segment prosody as a result of application of the modification values in the graph 604.

Figure 7:
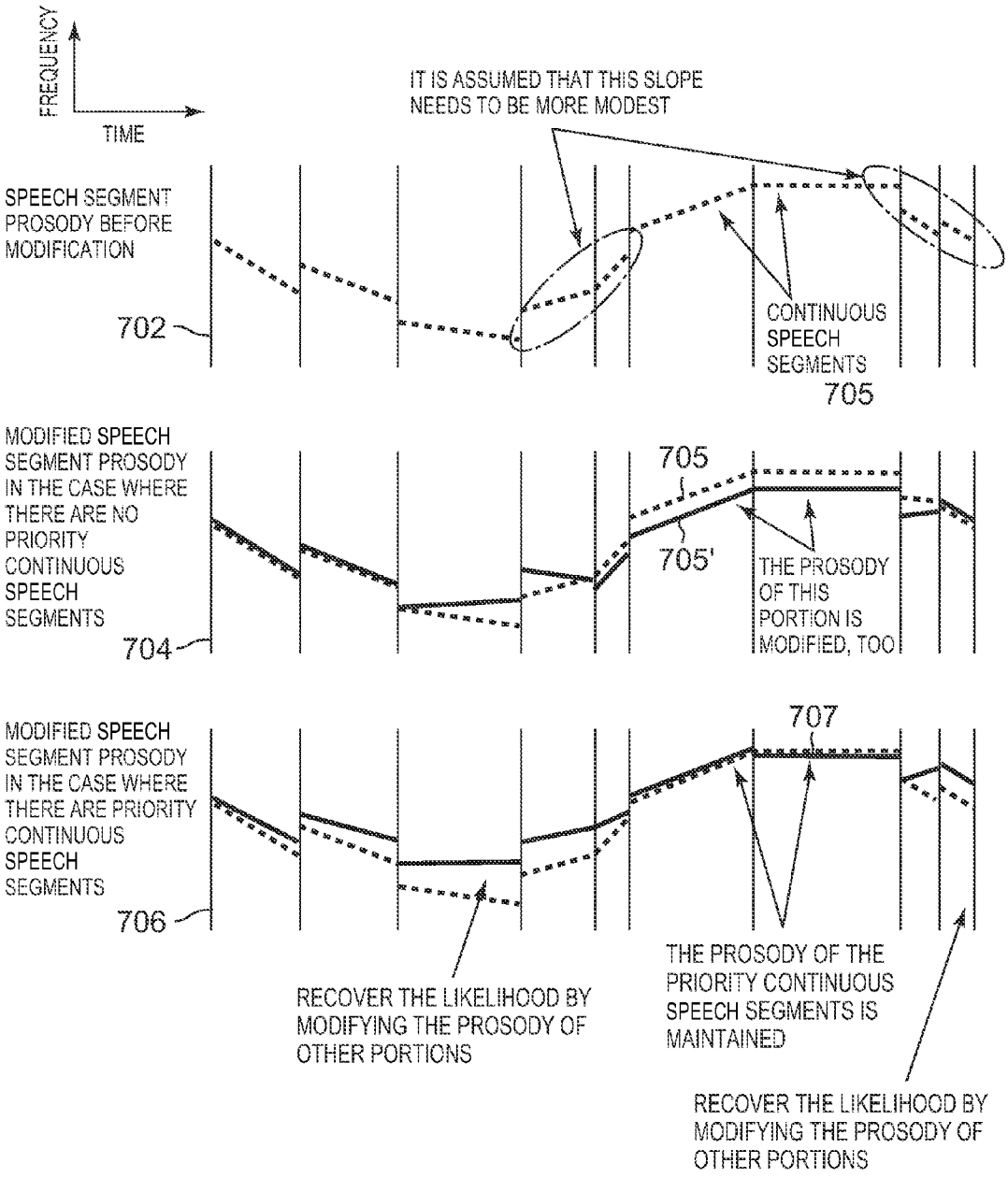

Referring to FIG. 7, there is shown processing performed in the case where the speech segment sequence includes the priority continuous speech segment prosody. A graph 702 of FIG. 7 shows the speech segment prosody which has not been modified yet. In FIG. 7, a speech segment before the modification is indicated by a dashed line and a speech segment after the modification is indicated by a solid line. Particularly, the speech segment sequence includes continuous speech segments 705. The continuous speech segments can be recognized by no level difference in the prosody at the joint between the speech segments. As shown in the flowchart of FIG. 5, however, the continuous speech segments are not immediately considered as priority continuous speech segments, but only in the case where the likelihood Ld of the slope of the continuous speech segments is greater than the threshold value Td, they are considered as priority continuous speech segments. Unless the continuous speech segments are considered as priority continuous speech segments as a consequence, they are treated as ordinary speech segments and therefore the continuous speech segments 705 are also modified into the phone segments 705' as shown in a graph 704.

On the other hand, if the continuous speech segments are considered as priority continuous speech segments, a large weight is used for the priority continuous speech segments in the prosody modification value search as shown in FIG. 5, and therefore the prosody modification values are not substantially applied to the continuous speech segments as shown by the waveform 707 of a graph 706. The prosody modification values, however, need to be applied so as to maximize the likelihood of the slope as a whole, and therefore the graph 706 shows that larger prosody modification values than in the graph 704 are applied to the portions other than the priority continuous speech segments.

In order to verify the effectiveness of the present invention, a subjective evaluation has been performed on the accuracy of accent in a synthesized speech. The following three objects have been adopted as those to be evaluated: the present invention, "application of speech segment prosody" which is a conventional approach, and "application of target prosody" which is one of the conventional technologies. Samples used for the evaluation are synthesized speeches each of which is composed of 75 sentences (approx. 200 breath groups) and the number of subjects is three. As a result, a significant improvement has been observed as shown in the Accent Precision column in the table below. Additionally, a result of the objective evaluation of the sound quality is shown in the rightmost column of the same table. The value indicates a prosody modification value of a speech segment by a root mean square: it is thought that the greater the value is, the more the sound quality is deteriorated by the prosody modification. As a result of the experiment, the prosody modification value is 10 Hz or more smaller than in the application of target prosody, though it is slightly greater than in the application of speech segment prosody, which proved that the present invention achieves a high accent precision with a high sound quality.

TABLE 1

| | Accent precision | | | |
|---|---|---|---|---|
| | Natural | Unnatural though accent type is correct | Incorrect accent type | Prosody modification value [Hz] |
| Application of speech segment prosody | 57.6% | 16.7% | 25.7% | 11.3 Hz |
| Application of target prosody | 74.2% | 13.9% | 12.0% | 30.5 Hz |
| Present invention | 91.2% | 5.88% | 2.94% | 17.7 Hz |

Subsequently, the same subjective evaluation of the accent precision has been performed for different comparison objects in order to verify the effectiveness of the components of the present invention. The comparison objects are as follows: the present invention; a case where the prosody modification of the present invention is not performed; and a case where all continuous speech segments are treated as priority continuous speech segments with Td of the present invention set to an extremely small value. The samples used for the evaluation are synthesized speeches each of which is composed of 75 sentences (approx. 200 breath groups) and the number of subjects is one. As a result, it has been proved that both of the prosody modification and Td are contributed to the improvement of the accent precision as shown in the following table:

TABLE 2

| | Natural | Unnatural though accent type is correct | Incorrect accent type |
|---|---|---|---|
| No modification | 78.8% | 11.6% | 9.53% |
| Low Td value | 85.7% | 7.41% | 6.88% |
| Present invention | 91.0% | 4.76% | 2.35% |

Finally, a model using the fundamental frequency slope of the present invention has been compared with a model [1] using a fundamental frequency difference under the same conditions without prosody modification in order to verify the superiority of the model using the fundamental frequency slope to the model [1] using the fundamental frequency difference. This evaluation has been performed simultaneously with the above evaluation. Therefore, the number of subjects and the number of samples are the same as those of the above. In consequence, it has been proved that the model using the fundamental frequency slope of the present invention is superior in accent precision as shown below.

TABLE 3

| | Natural | Unnatural though accent type is correct | Incorrect accent type |
|---|---|---|---|
| Delta pitch without prosody modification | 65.8% | 10.7% | 23.5% |
| Present invention without prosody modification | 78.8% | 11.6% | 9.53% |

Although the prosody modification value has been used in the frequency as an example in the above embodiment, the same method is also applicable to the duration. If so, the first path for the speech segment search is shared with the case of the frequency and the second path for the modification value search is used to perform the modification value search only for the duration separately from the pitch.

Furthermore, while the combination of GMM and the decision tree has been used as a statistical model in the above embodiment, it is also possible to apply the multiple regression analysis by Quantification Theory Type I, instead of the decision tree.

The invention claimed is:

1. A speech synthesis system for synthesizing speech from text, the system comprising:

a speech segment database configured to store a plurality of speech segments;

means for determining a first speech segment sequence corresponding to an input text, by selecting speech segments from the speech segment database-according to a first cost calculated based at least in part on a statistical model of prosody variations;

means for determining prosody modification values for the first speech segment sequence, after the first speech segment sequence is selected, by using a second cost calculated based at least in part on the statistical model of prosody variations, wherein the first cost is different from the second cost; and means for applying the determined prosody modification values to the first speech segment sequence to produce a second speech segment sequence whose prosodic characteristics are different from prosodic characteristics of the first speech segment sequence, wherein the second cost includes at least a prosody modification cost, the system further comprising means for increasing the prosody modification cost of continuous speech segments having a slope likelihood greater than a given value before determining the prosody modification values in response to detection of the continuous speech segments in the first speech segment sequence.

2. The speech synthesis system according to claim 1, wherein the first cost for determining the first speech segment sequence includes a spectrum continuity cost, a duration error cost, a volume error cost, an absolute frequency likelihood cost, a frequency slope likelihood cost, and a frequency linear approximation error cost.

3. The speech synthesis system according to claim 1, wherein the second cost for determining the prosody modification values includes an absolute frequency likelihood cost, a frequency slope likelihood cost, a frequency linear approximation error cost, and a prosody modification cost.

4. The speech synthesis system according to claim 1, wherein the statistical model uses a decision tree and Gaussian mixture models.

5. At least one computer-readable storage device encoded with a speech synthesis program which causes a system for synthesizing speech from text to perform:

determining a first speech segment sequence corresponding to an input text, by selecting speech segments from the speech segment database according to a first cost calculated based at least in part on a statistical model of prosody variations;

determining prosody modification values for the first speech segment sequence, after the first speech segment sequence is selected, by using a second cost calculated based at least in part on the statistical model of prosody variations, wherein the first cost is different from the second cost; and applying the determined prosody modification values to the first speech segment sequence to produce a second speech segment sequence whose prosodic characteristics are different from prosodic characteristics of the first speech segment sequence, wherein the second cost includes at least a prosody modification cost, the program further causing the system to perform the step of increasing the prosody modification cost of continuous speech segments having a slope likelihood greater than a given value in the first speech segment sequence before determining the prosody modification values in response to detection of the continuous speech segments.

6. The at least one computer readable storage device of claim 5, wherein the first cost for determining the first speech segment sequence includes a spectrum continuity cost, a duration error cost, a volume error cost, an absolute frequency likelihood cost, a frequency slope likelihood cost, and a frequency linear approximation error cost.

7. The at least one computer readable storage device of claim 5, wherein the second cost for determining the prosody modification values includes an absolute frequency likelihood cost, the frequency slope likelihood cost, a frequency linear approximation error cost, and a prosody modification cost.

8. The at least one computer readable storage device of claim 5, wherein the statistical model uses a decision tree and a Gaussian mixture model.

9. A speech synthesis method for synthesizing speech from text by computer processing, the method comprising:

determining a first speech segment sequence corresponding to an input text by selecting speech segments from a speech segment database-according to a first cost calculated based at least in part on statistical model of prosody variations;

determining prosody modification values for the first speech segment sequence, after the first speech segment sequence is selected, by using a second cost calculated based at least in part on the statistical model of prosody variations, wherein the first cost is different from the second cost; and applying the determined prosody modification values to the first speech segment sequence to produce a second speech segment sequence whose prosodic characteristics are different from prosodic characteristics of the first speech segment sequence, wherein the second cost includes at least a prosody modification cost, the method further comprising increasing the prosody modification cost of continuous speech segments having a slope likelihood greater than a given value in the first speech segment sequence before determining the prosody modification values in response to detection of the continuous speech segments.

10. The speech synthesis method according to claim 9, wherein the first cost for determining the first speech segment sequence includes a spectrum continuity cost, a duration error cost, a volume error cost, an absolute frequency likelihood cost, a frequency slope likelihood cost, and a frequency linear approximation error cost.

11. The speech synthesis method according to claim 9, wherein the second cost for determining the prosody modification values includes an absolute frequency likelihood cost, a frequency slope likelihood cost, a frequency linear approximation error cost, and a prosody modification cost.

12. A speech synthesis method according to claim 9, wherein the statistical model uses a decision tree and a Gaussian mixture model.

13. A speech synthesis system for synthesizing speech from text, the system comprising:

at least one processor configured to:

select a first speech segment sequence corresponding to an input text from a speech segment database by using a first cost value calculated based at least in part on a statistical model of prosody variations;

determine prosody modification values for the first speech segment sequence, after the first speech segment sequence is selected, by using a second cost value calculated based at least in part on the statistical model of prosody variations, wherein the first cost value is different from the second cost value; and apply the determined prosody modification values to the first speech segment sequence to produce a second speech segment sequence whose prosodic characteristics are different from prosodic characteristics of the first speech segment sequence, wherein the second cost includes at least a prosody modification cost, and the at least one processor is further configured to increase the prosody modification cost of continuous speech segments having a slope likelihood greater than a given value in the first speech segment sequence before determining the prosody modification values in response to detection of the continuous speech segments.

14. The system of claim 13, wherein the first cost for determining the first speech segment sequence includes a spectrum continuity cost, a duration error cost, a volume error cost, an absolute frequency likelihood cost, a frequency slope likelihood cost, and a frequency linear approximation error cost.

15. The system of claim 13, wherein the second cost for determining the prosody modification values includes an absolute frequency likelihood cost, a frequency slope likelihood cost, a frequency linear approximation error cost, and a prosody modification cost.

* * * * *